US005720267A

United States Patent [19]

Walk

[11] Patent Number: 5,720,267

[45] Date of Patent: Feb. 24, 1998

[54] ARCHERY BOW WITH LIMB MOUNTING POCKETS

[75] Inventor: Randy J. Walk, Tooele, Utah

[73] Assignee: Hoyt USA, Salt Lake City, Utah

[21] Appl. No.: 596,397

[22] Filed: Feb. 2, 1996

[51] Int. Cl.[6] ..... F41B 5/00

[52] U.S. Cl. ..... 124/23.1; 124/25.6

[58] Field of Search ..... 124/23.1, 25.6, 124/88, 86, 80

[56] References Cited

U.S. PATENT DOCUMENTS

| | | | |
|---|---|---|---|
| 1,605,300 | 11/1926 | Thompson | 124/88 X |
| 2,957,469 | 10/1960 | Wilkerson | 124/88 X |
| 3,821,946 | 7/1974 | Giggs | 124/23.1 |
| 3,921,598 | 11/1975 | Helmick | 124/88 X |
| 4,350,138 | 9/1982 | Caldwell | 124/23.1 |
| 4,644,929 | 2/1987 | Peck | 124/23.1 |
| 5,172,679 | 12/1992 | Mussack | 124/23.1 X |
| 5,280,779 | 1/1994 | Smith | 124/88 |
| 5,429,106 | 7/1995 | Martin | 124/23.1 |
| 5,464,001 | 11/1995 | Peck | 124/25.6 |

OTHER PUBLICATIONS

Advertisement for Tarantula Bow, "Bow and Arrow Magazine",Sep./Oct. 1968, p. 58.

Article entitled "Split Personality for a Bowyer", Bow and Arrow Magazine Sep./Oct 1968, pp. 64–65 and 66–67.

Picture of modified bow, "The Archers Magazine (TAM)", Apr. 1966, p. 43.

*Primary Examiner*—Terry Lee Melius

*Assistant Examiner*—Thomas A. Beach

*Attorney, Agent, or Firm*—Mallinckrodt & Mallinckrodt

[57] ABSTRACT

A limb mounting system for archery bows provides limb mounting pockets which receive and restrain the bottom, sides, and top of received limbs. The mounting system is particularly suited to bow limbs made up of a pair of spaced, side-by-side limb elements. With the top restraint provided by the pockets, the pockets, when pivotally mounted to the riser, can include a rotation limiting device to limit rotation of the pockets and prevent unintentional disassembly of the bow upon unintended release of the pockets.

15 Claims, 5 Drawing Sheets

ARCHERY BOW WITH LIMB MOUNTING POCKETS

BACKGROUND OF THE INVENTION

1. Field

The invention is in the field of compound archery bows, limbs therefor, and the mounting of limbs to a riser.

2. State of the Art

Traditional compound archery bows include a handle riser with bow limbs extending from opposite ends of the riser and with each limb having a V opening in the outer end thereof to accommodate an eccentric mounted for rotation therein. A bowstring and buss cables extend between the eccentrics so that when the bowstring is drawn, the eccentrics rotate and the limbs bend to store energy. When the bowstring is released, the limbs return to their undrawn position, rapidly returning the bowstring to its undrawn position to launch an arrow nocked to the bowstring.

There has been a continuing quest for bow configurations which increase the energy imparted to an arrow upon release of the bowstring and which increase the speed of an arrow shot from the bow. Much of this has been directed to the eccentric configuration but some has been directed to the bow limb configuration and the bow limb mounting.

In the late 1960's a bow was marketed under the Tarantulas name by Tarbell Special Archery Equipment, which, in effect, joined two normal recurve bows together in spaced side-by-side relationship. A bracket joining the risers formed the handle for the bow between the individual bow risers. Brackets joining respective limb tips provided attachment for a bowstring between the limbs. This provided a large, relatively heavy bow, which, while marketed for a year or more, is no longer marketed.

U.S. Pat. No. 4,350,138 shows a compound archery bow wherein the limbs of a conventional shape are split along most or all of their length to form two separate limb portions or halves. The limbs are not of uniform width throughout their length, but, when mounted side-by-side, give the appearance of two halves of a conventional limb. A limb mounting pocket is sandwiched between the limb and the end of the riser to keep the limb in alignment, while an unsplit inward end of the limb has a weight bolt passing therethrough in normal manner to secure the limb pocket to the riser.

U.S. Pat. No. 4,644,929 shows a limb made up of a pair of separate limb elements of uniform width throughout their length. The inward ends of the limb elements include a pivot projection which is received by an indentation in the end of the riser. A cap fits over the inward ends of the limb elements and is secured to the riser in normal fashion by a weight bolt to secure the limb elements to the riser.

U.S. Pat. No. 5,429,106 shows a modular limb system wherein limb elements are secured to inner end pieces which are then secured to the ends of a riser. The limb elements are joined along their length by either clasps spaced along their length or outer pieces which join the ends of the limb elements and which mount the wheels.

U.S. Pat. No. 5,280,779 shows a pocket mounting system for conventional archery bow limbs wherein the pocket is pivotally mounted to the riser and a bow limb fits into the pocket and is attached in normal manner to the bow with a weight bolt, with the pocket sandwiched between the limb and the riser. With this, as with other pocket limb mounting systems, such as the one of U.S. Pat. No. 4,350,138 described above, the pocket does not extend over the top of the limb ends. If the weight bolt is accidentally released from the riser, the limbs are released from the pocket and from the bow. Similarly, with non-pocket mounting systems that use a weight bolt to adjustably mount the limbs, release of the weight bolt releases the limbs from the bow.

None of the prior art patents show a pocket system specifically adapted to hold a pair of separate limb elements in side-by-side relationship to form a limb and provide easy mounting and adjustment of a limb made up of a pair of limb elements. Further, none of the patents show a pocket system which will keep the limbs from separating from the pocket and thus from the bow and keep the bow from coming apart if the weight bolt is accidentally completely unscrewed from the riser.

SUMMARY OF THE INVENTION

According to the invention, the bow limbs of an archery bow are mounted to the riser by limb mounting pockets which, in addition to the bottom and side constraint provided by prior art mounting pockets, provides top constraint. In a particularly advantageous use of the mounting pockets of the invention, a bow of the invention is formed wherein the bow limbs are made up of a pair of limb elements held in spaced apart, side-by-side relationship by the mounting pockets. Preferably the limb elements are of uniform width throughout their length. The mounting pockets may include a bottom pocket member and a top pocket member with the inner ends of the limb elements held securely between the top and bottom pocket members or the pockets may merely provide close fitting receiving passages for the ends of the limbs into which the limb ends are inserted. In either case the pockets position the inner ends of the limb elements in the desired spaced configuration and provide top, bottom, and side constraint for the limb elements.

The pockets may be pivotally mounted to the riser with a weight bolt extending through the pocket and threaded into the riser to adjust the position of the pocket. The pocket may include an extension therefrom to limit the extent of rotation of the pocket should the weight bolt be completely unscrewed from the riser. With such limit of rotation of the pocket, and with the top of the limb constrained by the pocket, the limb will not separate from the bow.

THE DRAWINGS

The best mode presently contemplated for carrying out the invention is illustrated in the accompanying drawings, in which:

FIG. 1 is a fragmentary perspective view of a bow of the invention showing the lower limb pocket and inner ends of the lower limbs in assembly format to illustrate the mounting of the limbs and limb pockets to the riser;

FIG. 2, a fragmentary side elevation of the pocket and limb mounting of FIG. 1, taken on the line 2—2 of FIG. 1;

FIG. 3, a fragmentary side elevation similar to that of FIG. 2, but showing the pocket and limb in a loosened position;

FIG. 4, a fragmentary top plan view of the pocket and portion of the riser and limb shown in FIG. 2;

FIG. 5, a fragmentary vertical section taken on the line 5—5 of FIG. 2;

FIG. 6, a fragmentary vertical section taken on the line 6—6 of FIG. 2;

FIG. 7 a fragmentary vertical section taken on the line 7—7 of FIG. 4;

FIG. 8, a fragmentary side elevation similar to that of FIG. 2, but of a second embodiment of limb mounting pocket;

FIG 9, a fragmentary side elevation similar to that of FIG. 8, but showing the pocket and limb in a loosened position;

FIG 10, a fragmentary top plan view of the pocket and portion of the riser and limb shown in FIG. 8;

FIG. 11, a fragmentary vertical section taken on the line 11—11 of FIG. 8;

FIG. 12, a fragmentary vertical section taken on the line 12—12 of FIG. 8;

FIG. 13, a fragmentary vertical section taken on the line 13—13 of FIG. 10;

FIG. 14, a fragmentary side elevation similar to that of FIG. 2, but of a third embodiment of limb mounting pocket;

FIG. 15, a fragmentary side elevation similar to that of FIG. 14, but showing the pocket and limb in a loosened position;

FIG. 16, a fragmentary top plan view of the pocket and portion of the riser and limb shown in FIG. 14;

FIG. 17, a fragmentary vertical section taken on the line 17—17 of FIG. 14;

FIG. 18, a fragmentary vertical section taken on the line 18—18 of FIG. 14;

FIG. 19, a fragmentary vertical section taken on the line 19—19 of FIG. 16;

FIG. 20, a fragmentary top plan view of the upper end of the riser of FIG. 1 showing the upper pocket and upper limb, taken on the line 20—20 of FIG. 1;

FIG. 21, a perspective view of the pocket shown in FIGS. 8 through 13;

FIG. 22, a perspective view of the pocket shown in FIGS. 14 through 19; and

FIG. 23, a bottom plan view of the top pocket member of FIG. 22, taken in the line 23—23 of FIG. 22.

DETAILED DESCRIPTION OF THE ILLUSTRATED EMBODIMENT

Figures 1, 20:
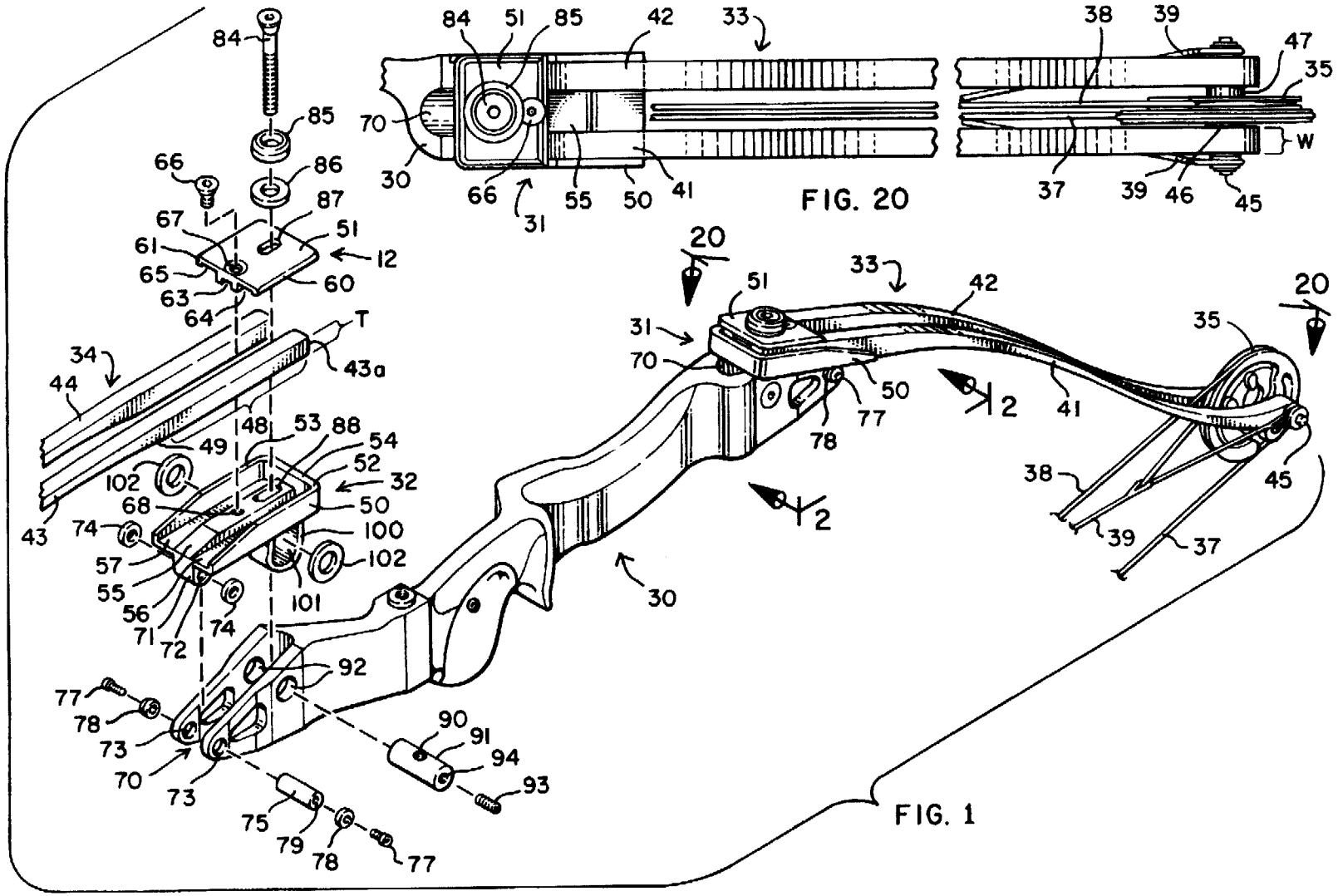
Figure 4:
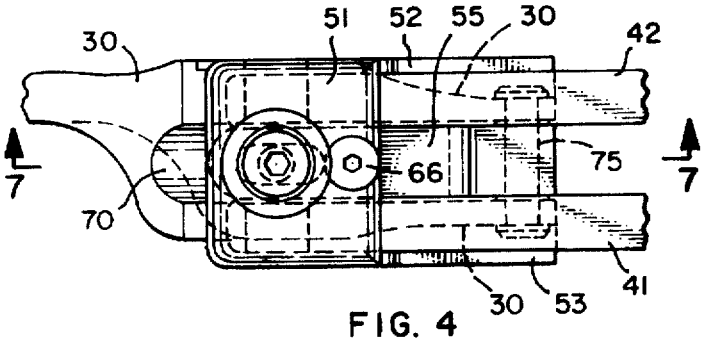
Figure 6:
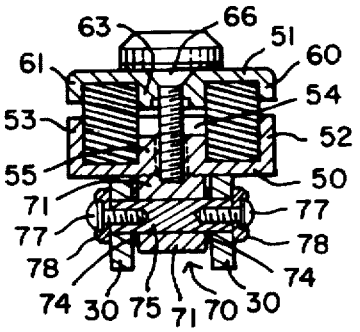
Figure 2:
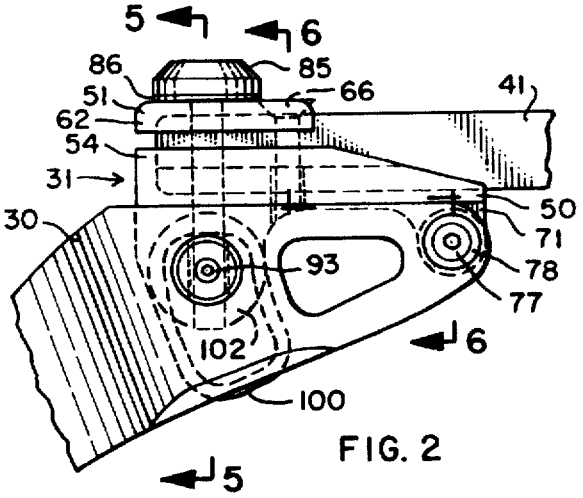
Figure 5:
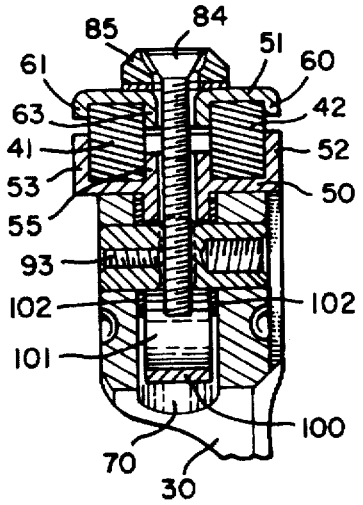
Figure 7:
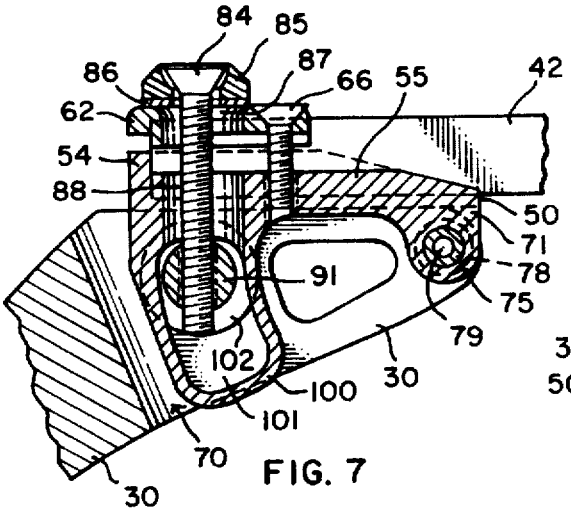

A compound archery bow generally includes a handle riser 30, FIG. 1, with means, here shown as upper and lower limb mounting pockets 31 and 32, respectively, to mount upper and lower limbs 33 and 34, here each of the upper and lower limbs 33 and 34 being shown as made up of two limb elements, to the respective upper and lower ends of the handle riser 30. Upper and lower wheels (sometimes referred to as eccentrics), only the upper wheel 35 being shown in FIGS. 1 and 20 but a similar wheel being mounted at the end of the lower limb, are mounted for eccentric rotation with bow string 37 extending between the upper and lower wheels, and buss cables 38 and 39 extending between a wheel and opposite limb tip. In conventional compound bows, each limb is of single piece construction with the inner end of each limb having a rounded pivot area which contacts the riser to mate with a receiving recess in the end of the riser. A weight adjustment bolt extends through a hole in the inward end of the limb and into the riser. The weight adjustment bolt has a large head and washer to securely hold the inner end of the limb to the riser. Adjustment of the weight bolt allows the limb to pivot about its rounded pivot area to adjust the weight rating of the bow. In instances where limb mounting pockets are used, a pocket generally extends between a limb and the riser end so that the limb is mounted against the pocket rather than against the end of the riser. Again, a weight bolt extends through the end of the limb to hold the limb against the pocket and adjust the pocket pivot position with respect to the riser.

The current invention provides improved pocket mountings for archery bow limbs, and provides a pocket which can easily mount two limb elements in spaced, side-by-side configuration to form a two piece limb. Certain improvements in the pocket construction, however, are not limited to the mounting of two piece limbs and can also be used with single piece, conventional limbs.

As shown in FIGS. 1 and 20, a bow of the invention includes limbs each made up of a pair of separate limb elements. Thus, upper limb 33 is made up of two spaced limb elements 41 and 42. Similarly, lower limb 34 is made up of two spaced limb elements 43 and 44. As shown in FIG. 20, each limb element is of uniform width W throughout its length. This has been found preferred for two piece limb construction. The thickness of each limb element may be varied along its length to adjust the strength and flex characteristics as desired along the length of each limb element. Thus, as shown in FIG. 1, the thickness T of each limb element varies along its length, with the limb elements being thickest at their inward ends where they are mounted to the riser and at their outward ends where wheel axle 45 extends through the limb elements to mount the wheels, such as upper wheel 35. Spacers 46 and 47 are generally provided on axle 45 between wheel 35 and limb elements 41 and 42 to properly position wheel 35 and space the ends of limb elements 41 and 42.

As shown in FIG. 1, and particularly visible for limb elements 43 and 44 of lower limb 34, the inward end portions of limb elements 43 and 44 have an end portion 48 of substantially uniform thickness. Beyond the end portion 48, as at 49, the bottom surface of each limb element (the surface facing the bow string and archer) tapers toward the top surface. From there the thickness of the bow limb elements vary as desired with the bottom surface tapering outwardly again to a relatively thick outward end as seen for the upper limb elements in FIG. 1. The thickest portion of the limb elements will generally be the inward end portion 48. The limbs may be constructed of various well-known materials in various well-known ways. For ease of illustration, cross-sectional showings of the limbs in the figures will merely be schematic without showing detailed limb construction.

As shown in FIGS. 1–7 and 20, the limb elements are mounted to the riser using a limb mounting pocket which includes both a bottom pocket member and a top pocket member. Since the upper pocket 31 and lower pocket 32 as shown in FIG. 1 are the same, the pocket parts and pocket mounting parts will be similarly numbered and the detailed description and showing for the lower pocket in FIG. 1 and for the upper pocket in FIGS. 2–7 apply to either pocket. Thus, as shown in FIGS. 1 and 20 and in FIGS. 2–7, each limb mounting pocket includes a bottom pocket member 50 and top pocket member 51. Bottom pocket member 50 includes opposite side walls 52 and 53 and rear wall 54. A central longitudinal divider 55 divides the area between side walls 52 and 53 into two spaced limb element receiving channels 56 and 57 which receive the inward ends of the limbs elements. These limb elements are indicated as 43 and 44, respectively, for the lower limb shown in FIG. 1, and as 41 and 42, respectively, for the upper limb shown in FIGS. 2–7 and 20.

Top pocket member 51 includes side walls 60 and 61 and end wall 62. It also includes a central divider 63 to form receiving channels 64 and 65 for the limb elements. With the inward ends of the limb elements received in channels 56 and 57 of the bottom pocket member, top pocket member 51 is placed over the inward ends of the limb elements with the limb ends also received in channels 64 and 65 of top pocket member 51. A screw 66 passes through hole 67 in top pocket member 51 and is threaded into receiving hole 68 in bottom pocket member 50. This secures the top and bottom pocket members and sandwiches the inward ends of the bow limbs therebetween. With this pocket construction, the pocket importantly provides bottom, side, and top constraint for each of the limb elements.

As seen in FIGS. 1 and 20, riser 30 has end slots 70 in the ends thereof for pivotal mounting of the limb mounting pockets. Bottom pocket member 50 includes mounting tab 71 extending from the bottom side thereof with bore 72 therethrough. Tab 71 is sized to fit within slot 70 with bore 72 in alignment with holes 73 in riser 30 and with washers 74 positioned between opposite sides of tab 71 and the sides of slot 70. Pivot pin 74 extends through holes 73 in the ends of riser 30, through aligned washers 74, and through hole 72 in tab 71 to thereby pivotally mount bottom pocket member 50 to an end of riser 30. Pivot pin 75 is held in position in riser 30 by screws 77 which extend through end caps 78 larger than holes 73, and are threaded into holes 79 in pin 75, see particularly FIGS. 1 and 6.

Figure 3:
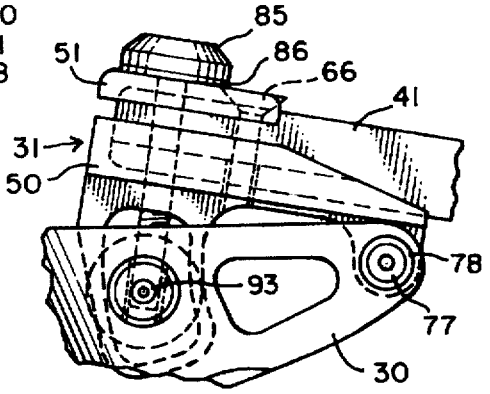
Figure 10:
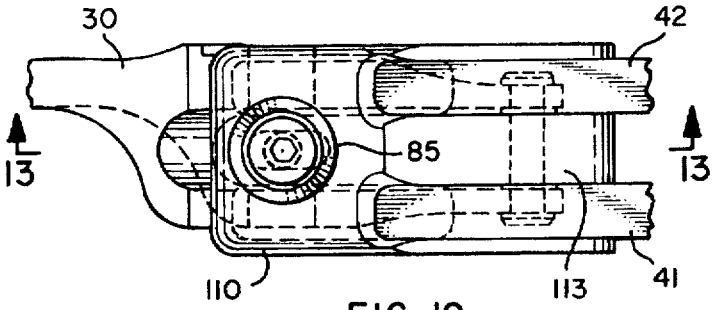
Figure 12:
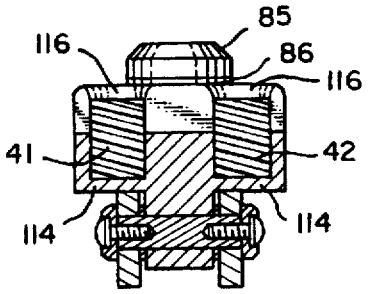
Figure 8:
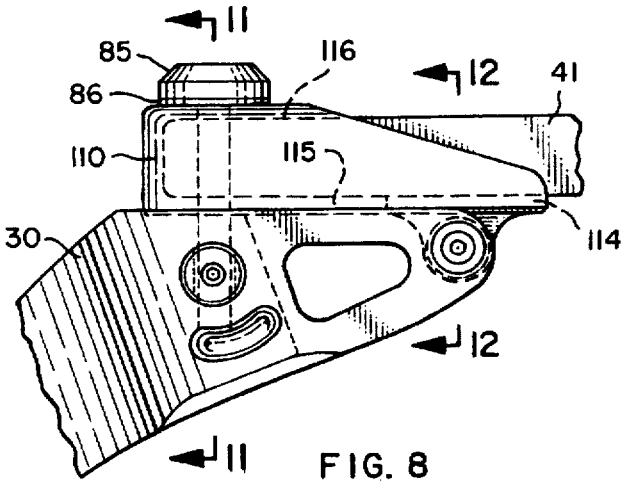
Figure 11:
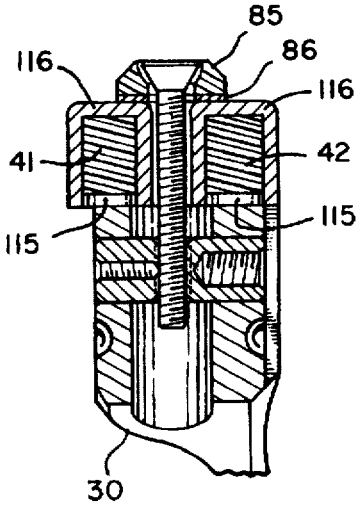
Figure 13:
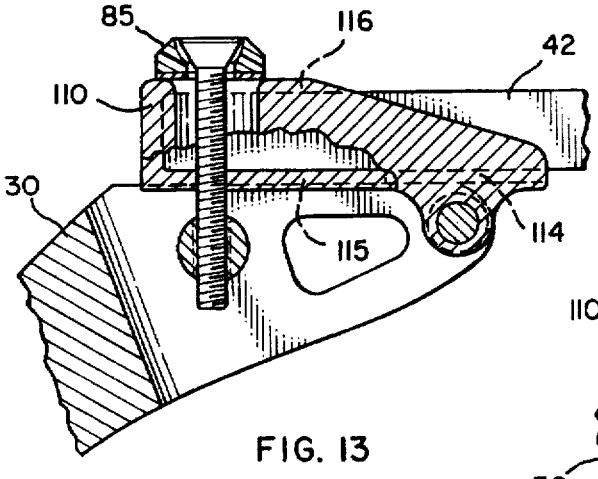
Figure 9:
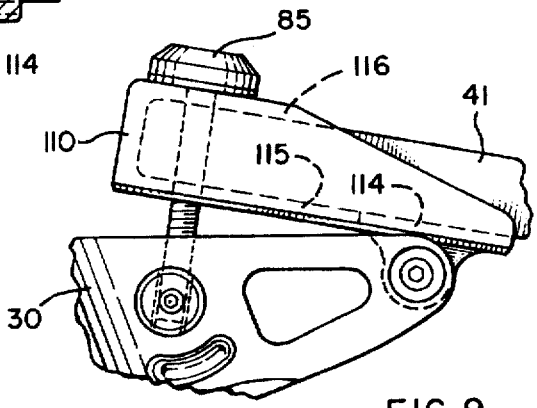
Figure 16:
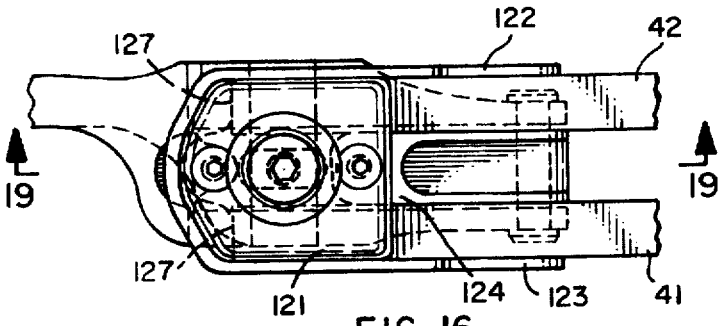
Figure 18:
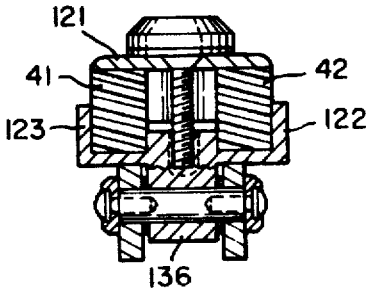

The limb mounting pocket, 31 or 32, can pivot about pivot pin 75 to adjust the weight of the bow in normal manner as well known. FIG. 1 and 2 and 4–7 show the pocket adjusted for maximum bow weight with, for upper pocket 31, the pocket against bow riser 30. FIG. 3 shows the pocket pivoted away from riser 30 about pivot pin 75 to reduce the weight of the bow. In order to adjust the position of the pocket about pivot pin 75 and to hold the pocket in adjusted position, weight bolt 84 passes through cap 85, washer 86, slot 87 in top sleeve member 51, and slot 88 in bottom sleeve member 50, and is threaded into hole 90 in dowel nut 91. Dowel nut 91 extends through slot 70 and is rotatably mounted in holes 92 extending through riser 30 on opposite sides of slot 70. Rotation of weight bolt 84 in one direction will screw weight bolt 84 into dowel nut 91 and rotate pocket 31 toward the position shown in FIGS. 1 and 2. Rotation of weight bolt 84 in the opposite direction will allow the pocket 31 to rotate about pin 75 away from riser 30 to the position shown in FIG. 3 and beyond that position, if desired. While generally not necessary, if desired, when adjusted to desired weight position, a set screw 93 can be threaded into central bore 94 and tightened against weight bolt 84 where it passes through dowel nut 91, see FIGS. 1 and 5, to secure weight bolt 84 in position with respect to dowel nut 91.

A specific improvement in the pocket construction shown in FIGS. 1–7 is the provision, in combination with a pocket which provides top constraint to the limbs, of a dowel nut extension 100 extending from the bottom surface of the bottom pocket member and adapted to fit into slot 70 in riser 30 with a closed slot 101 therein through which dowel nut 91 passes. With dowel nut 91 in slot 101, if weight bolt 84 is accidently unscrewed to adjust the bow to the extent that weight bolt 84 completely comes out of dowel nut 91, dowel nut extension 100 will stop rotation of the limb mounting pocket when the end of slot 101 hits dowel nut 91. This will generally be at a position of the limb mounting pockets to still maintain the bow together and prevent unlimited rotation of the limb mounting pockets and limbs mounted therein to an extend that the bow comes apart. Generally washers 102 will be positioned around dowel nut 91, between dowel nut extension 100 and the riser 30 at the edges of slot 70.

FIGS. 8–13 and 21 show a second embodiment of a limb mounting pocket. In the embodiment of FIGS. 8–13 and 21, the bottom limb pocket member and the top limb pocket member are integrally formed into a one piece limb mounting pocket 110. The mounting pocket 110 includes limb element mounting passages 111 and 112. These passages are sized to closely but freely receive the inward mounting ends of the limb elements. It has been found that when a bow is strung, the force applied to the limb elements by the bow string and buss cables is sufficient to keep the limb elements fully and securely forced into receiving passages 111 and 112 without the need for the limb elements being tightly sandwiched or otherwise secured in the passages. Thus, mounting pocket 110 may be machined or otherwise formed of a single piece with limb element receiving passages 111 and 112 separated by a divider 113 the width of the desired spacing between limbs. The length of passages 111 and 112 are sufficient to align the limb elements and maintain such alignment (the outward ends of the limbs will be spaced by the wheel 35, FIG. 1, and axle 45, with spacers 46 and 47 if desired between the wheel and the limb ends) and the passages need have a top portion for top constraint of the limb elements only at the rear portion of the passages. The forward portion of the passages may merely form open channels. This covered portion, however, must be sufficient to hold the inward ends of the limb elements and withstand all of the force applied to hold the bow in brace condition and to bend the limbs when the bow is drawn. Further, it is not necessary that passages 111 and 112 have a bottom throughout their length. Such passages can be formed with a bottom 114, FIGS. 8, 9, 11, and 12 in the forward portion of the passages which do not have a top portion, and have an open bottom 115 in the inward portion of the passages, particularly the portion having the top 116. In the machining of pocket 110, it is easier if passages 111 and 112 are formed without a bottom under the portion of the portions that have a top covering.

Pocket 110 has tab 117 extending from its lower surface with a pivot mounting hole 118 therethrough. The pocket is mounted on the bow riser similarly as described for the pocket of FIGS. 1–7 and is shown in FIGS. 8–13. It is not described again here in detail. This embodiment is not shown with a dowel nut extension or slot (the dowel nut extension and slot could be provided), but is secured in position to the riser and adjusted similarly to the embodiment of FIGS. 1–7. Weight bolt 84 passes through slot 119 with cap 85 and washer 86 holding pocket 110 as described for the previous embodiment.

FIGS. 14–19, 22, and 23 show a third embodiment of limb mounting pocket. This is a two piece pocket as with the embodiment of FIGS. 1–7 and includes a bottom limb pocket member 120 and a top limb pocket member 121. Bottom pocket member 121 includes side walls 122 and 123 with a central spacer 124 in the forward portion of bottom member to form limb receiving channels 125 and 126. With the embodiment of FIGS. 1–7 and 8–13, where the ends of the bow limb element receiving channels or passages are machined, the corners are rounded as a result of the machining process. This requires that the inward end edges of the bow limbs be rounded or tapered as at **43*a* for limb 43 in FIG. 1 so that the inner ends of the limb elements will abut the ends of the channels. This means that the force pushing inwardly on the bow limbs is counteracted over the area of the inner ends of the limbs and the abutting back wall of the channel or passage. If the edges of the inner end of the limb are not rounded or tapered inwardly, the limb ends will not rest against the channel or passage ends and the inward force is applied only to the edges of the limb elements and the radiused corners of the inner ends of the pockets. In the embodiment of pocket shown in FIGS. 14–19, 22 and 23, a flat end surface 127** is positioned to form the channel ends upon which the inward ends of the limb elements abut.

Surface 127 is provided by flange 128 extending downwardly from the upper pocket member 121 into the lower pocket member 120 when the two are assembled together. With the construction as a flange, the surface 127 can be machined flat and provide a flat inner end for bow limb element receiving channels 125 and 126. This means that the bow limb elements received in such receiving channels do not have to have the edges tapered or rounded to securely abut the ends of the channels. This advantageously cuts out a step in the manufacture of the limb elements.

Flange 128 of top pocket member 121 fits into the forward end of bottom pocket member 120 and flange 129 fits adjacent the inner edge of central spacer 124. Screws 130 and 131 pass through holes 132 and 133 in top pocket members 121 and are threaded into holes 134 and 135 of bottom pocket member 120 to securely hold the top and bottom pocket members together. Mounting tab 136 with hole 137 pivotally mounts the pocket to the riser as described for previous embodiments. Weight bolt 84 passes through slots 138 and 139 to secure and adjust the pocket in desired pivoted position as previously described. A dowel nut extension 140 is shown for this embodiment.

Figure 14:
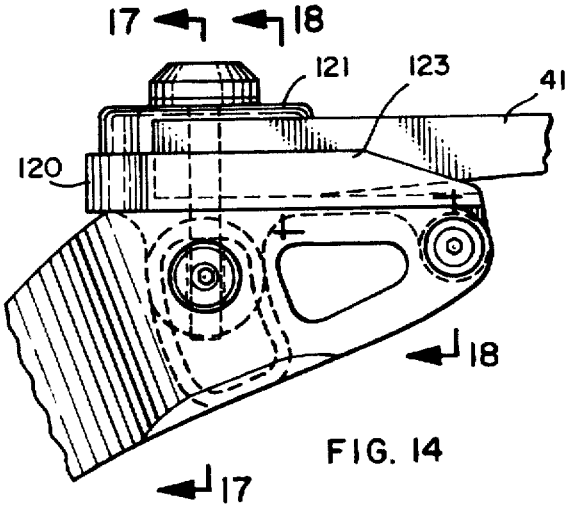
Figure 17:
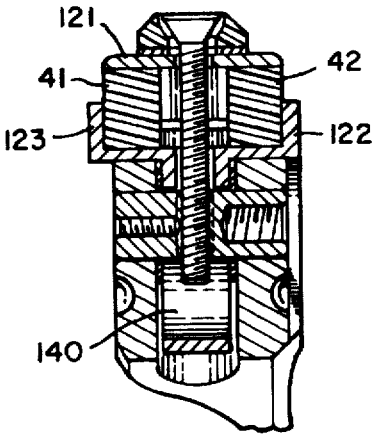
Figure 19:
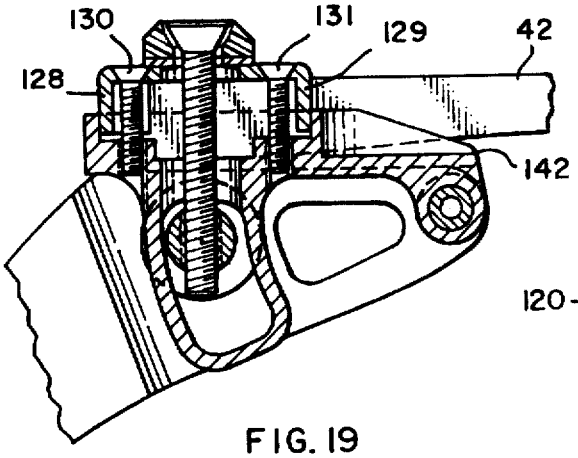
Figure 15:
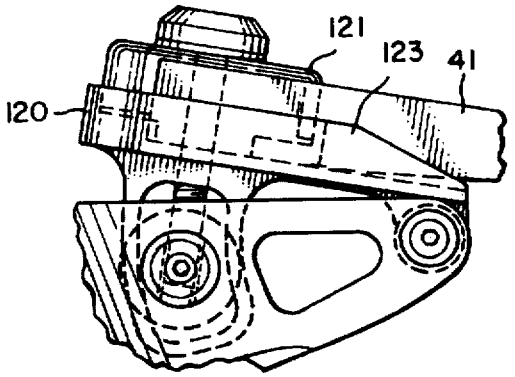
Figure 21:
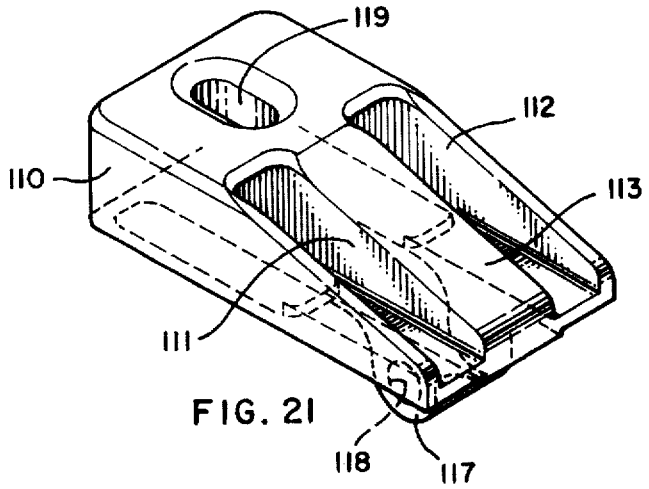
Figure 22:
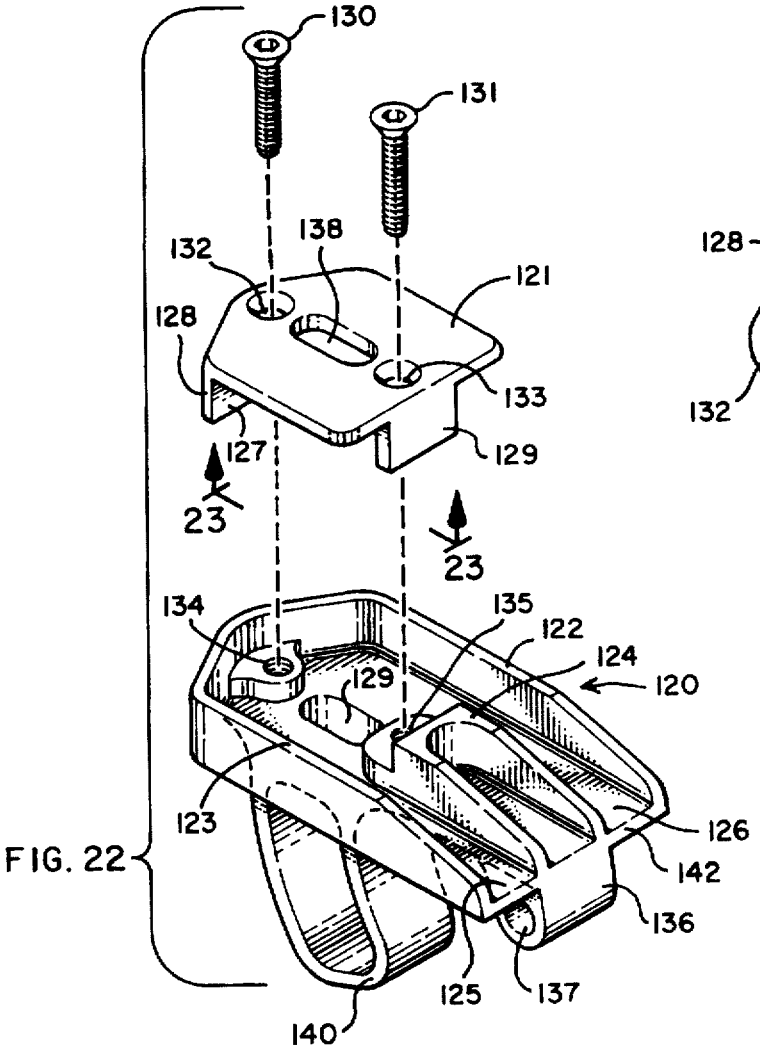
Figure 23:
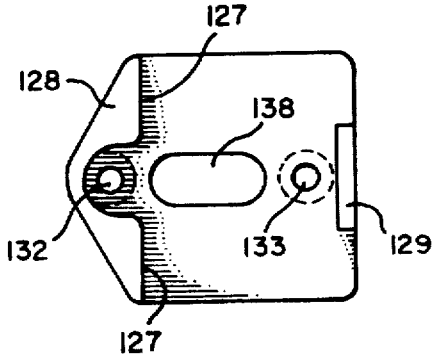

As indicated previously, the inward limb element ends have an end portion 48, FIG. 1, of substantially uniform thickness. Beyond these end portions, the bottom surface starts to taper, as at 49, toward the top surface of the limb elements. It is presently preferred that the length of the receiving channels or passages in the limb mounting pockets be somewhat longer than the uniform thickness limb end portion 48. With this arrangement, as shown in FIGS. 14, 15, and 19, the limb elements begin to taper upwardly before the limb elements reach the forward edge 142 of the bottom pocket member 120 so do not contact the forward edge 142 of the bottom pocket member. The limb taper is preferably such that the limb elements will not contact the forward edge of the pocket member when the bow is in brace position or when in fully drawn position. This avoids any additional stress that might be put on the limb by contact with and bending against the formed edge 142 of the pocket and eliminates any need to radius or bend such formed edge.

While avoiding contact with the forward edge of the pocket may be advantageous, it is not necessary and straight limbs can be used with the mounting pockets of the invention. Such straight limbs would appear as in FIGS. 8–13. Such limbs could be uniform in thickness throughout their length, or could merely have the taper start beyond the limb pocket. Further, a taper could be in the top side of the limb rather than in the bottom side.

While the invention has been shown in connection with bow limbs made up of two separate spaced apart limb elements, and such bow is a part of the invention, the pockets of the invention which provide top constraint to the limbs apart from and in addition to any top constraint provided by the weight adjustment bolt, may be used with conventional one piece limbs as well, and with such limbs, will provide protection against the limb separating from the bow if the weight bolt is released from the riser, and, where a limb receiving passage is provided, will allow the limb to be inserted into the passage without other attachment.

With the limbs formed of two limb elements, the pocket system of the invention provides easy attachment of the two separate limb elements and more secure attachment of the limb elements to the riser.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An archery bow comprising:

a handle riser having opposite ends;

limb mounting pockets separate from but secured to the opposite ends of the handle riser, each limb mounting pocket forming receiving channels to receive inward mounting ends of a pair of spaced limb elements each limb element having top, bottom, and side surfaces, the receiving channels extending at least partially about the top, bottom, and side surfaces of the inward mounting end of the limb elements to provide top, bottom, and side constraint for each limb element;

the pair of limb elements being mounted in the receiving channels of each of said limb mounting pockets, each limb element having an inward mounting end received by the limb mounting pocket and an outward end, each pair of limb elements being mounted in a mounting pocket to extend outwardly in substantially parallel, spaced apart relationship;

an axle extending between and mounted to the respective outward ends of each pair of limb elements on which an eccentric is rotatably mounted between the limbs, the spacing of the limbs being sufficient to accommodate the eccentric therebetween; and means mounting a bow string to extend between the eccentrics.

2. An archery bow according to claim 1, wherein the limb mounting pockets include a bottom pocket member and a top pocket member secured to the bottom pocket member with the inward mounting ends of the limb elements therebetween.

3. An archery bow according to claim 1, wherein the limb mounting pockets include limb receiving passages for receiving the inward mounting ends of the limb elements therein, said passages providing top, bottom, and side constraint to the limb elements.

4. An archery bow according to claim 1, wherein the limb mounting pockets are secured to the riser by securing means, and wherein the securing means includes means for pivotally mounting the pockets to the riser, and adjusting means for adjusting the pivotal position of the pocket about its pivotal mounting and holding the pocket in its adjusted position.

5. An archery bow according to claim 4, additionally including means to limit movement of the pocket about its pivotal mounting should the adjusting means fail to hold the pocket in position.

6. An archery bow according to claim 1, wherein the limb mounting pockets have an outward bottom edge; the limb elements have a bottom side facing the archer and a top side, the inward mounting end of each limb element is relatively thick, and the bottom side of the limb elements taper toward the top side of the limb elements as the limb elements extend from the mounting pocket so that the limb elements do not contact the mounting pocket outward bottom edge during drawing of the bow.

7. An archery bow comprising:

a handle riser having opposite ends;

a pair of limbs, each limb having an inward mounting end and an outward end and having top, bottom, and side surfaces;

limb mounting pockets separate from but secured to the opposite ends of the riser, each limb mounting pocket forming a securing channel to receive the inward mounting end of a limb therein so that the limbs extend outwardly therefrom, the limb mounting pocket extending at least partially about the top, bottom, and side surfaces of the inward mounting end of the limb to provide top, bottom, and side constraint for said inward mounting end of the limb; and means mounting a bowstring to extend between outward ends of the limbs.

8. An archery bow comprising:

a handle riser having opposite ends;

limb mounting pockets secured to the opposite ends of the handle riser, each limb mounting pocket adapted to receive a pair of spaced limb elements to provide top, bottom, and side constraint for each limb element;

means for pivotally mounting each of the pockets to the riser;

adjusting means associated with each pocket for adjusting the pivotal position of the pocket about its pivotal mounting and for holding the pocket in its adjusted position;

means to limit movement of the pocket about its pivotal mounting should the adjusting means fail to hold the pocket in position;

the pair of limb elements being mounted in each of said limb mounting pockets, each limb element having an inward mounting end received by the limb mounting pocket and an outward end, each pair of limb elements being mounted in a mounting pocket to extend outwardly in substantially parallel, spaced apart relationship;

an axle extending between and mounted to the respective outward ends of each pair of limb elements on which an eccentric is rotatably mounted between the limbs, the spacing of the limbs being sufficient to accommodate the eccentric therebetween; and means mounting a bow string to extend between the eccentrics.

9. An archery bow according to claim 8, wherein the means to limit movement of the pocket about its pivotal mounting is a limit slot formed in a portion of the pocket which cooperates with a projection from the handle riser which extends into the limit slot.

10. An archery bow according to claim 9, wherein the pocket includes an extension thereof extending adjacent the handle riser in a direction of rotation about the pivotal mounting, and the limit slot is in the extension.

11. An archery bow according to claim 10, wherein the handle riser includes an end slot at each end of the riser, wherein the extension extends into the end slot, and wherein the projection extends through the limit slot and the end slot.

12. An archery bow comprising:

a handle riser having opposite ends;

a pair of limbs, each limb having an inward mounting end and an outward end;

limb mounting pockets secured to the opposite ends of the riser, each limb mounting pocket receiving the inward mounting end of a limb therein so that the limbs extend outwardly therefrom, the limb mounting pocket providing top, bottom, and side constraint for said inward mounting end of the limb;

means for pivotally mounting each of the pockets to the riser;

adjusting means associated with each pocket for adjusting the pivotal position of the pocket about its pivotal mounting and for holding the pocket in its adjusted position;

means to limit movement of the pocket about its pivotal mounting should the adjusting means fail to hold the pocket in position; and means mounting a bowstring to extend between outward ends of the limbs.

13. An archery bow according to claim 12, wherein the means to limit movement of the pocket about its pivotal mounting is a limit slot formed in a portion of the pocket which cooperates with a projection from the handle riser which extends into the limit slot.

14. An archery bow according to claim 13, wherein the pocket includes an extension thereof extending adjacent the handle riser in a direction of rotation about the pivotal mounting, and the limit slot is in the extension.

15. An archery bow according to claim 14, wherein the handle riser includes an end slot at each end of the riser, wherein the extension extends into the end slot, and wherein the projection extends through the limit slot and the end slot.

* * * * *